US006749408B1

(12) United States Patent
Eilertsen

(10) Patent No.: US 6,749,408 B1
(45) Date of Patent: Jun. 15, 2004

(54) PISTON PUMP

(75) Inventor: Bjorn Eilertsen, Hundvag (NO)

(73) Assignee: Engineering & Drilling Machinery AS, Bryne (NO)

( * ) Notice: Subject to any disclaimer, the term of this patent is extended or adjusted under 35 U.S.C. 154(b) by 0 days.

(21) Appl. No.: 10/111,023

(22) PCT Filed: Oct. 17, 2000

(86) PCT No.: PCT/NO00/00341

§ 371 (c)(1),
(2), (4) Date: Sep. 4, 2002

(87) PCT Pub. No.: WO01/29415

PCT Pub. Date: Apr. 26, 2001

(30) Foreign Application Priority Data

Oct. 18, 1999 (NO) ..... 19995084

(51) Int. Cl.[7] ..... F04B 35/04
(52) U.S. Cl. ..... 417/415; 417/534; 92/136
(58) Field of Search ..... 417/341, 401, 417/534, 415; 92/136

(56) References Cited

U.S. PATENT DOCUMENTS 545,032 A * 8/1895 Wood ..... 417/534
2,027,877 A * 1/1936 Pescara ..... 417/341
2,734,353 A * 2/1956 Hill ..... 92/136
3,444,784 A * 5/1969 Wengerd ..... 92/136
3,501,088 A * 3/1970 Braun ..... 417/401

FOREIGN PATENT DOCUMENTS

WO 98/36192 8/1998

OTHER PUBLICATIONS

Derwent's Abstract, No. 94–331434*41, week 9441, Abstract of SU 1820028–A1 (Potapov N P), Jun. 7, 1993.

* cited by examiner

*Primary Examiner*—Michael Koczo
(74) *Attorney, Agent, or Firm*—Knobbe, Martens, Olson & Bear, LLP

(57) ABSTRACT

A piston pump assembly having a single drive gear assembly associated with two adjacent pump cylinders. Each pump cylinder has a separate valve unit associated therewith. The two pump cylinders have a common piston rod having a pump piston arranged at each end. The piston pod is formed as a toothed rack and the drive gear assembly includes motor-driven gearwheels engaged with the toothed rack.

4 Claims, 5 Drawing Sheets

PISTON PUMP

RELATED APPLICATIONS

This application claims the benefit of the Norwegian application 19995084 filed Oct. 18, 1999 and the international application PCT/NO00/00341 filed Oct. 17, 2000.

BACKGROUND OF THE INVENTION

1. Field of the Invention

The present invention relates to a piston pump as disclosed in the preamble of claim 1.

2. Description of the Related Art

The invention has been especially developed as a drilling fluid pump. The standard drilling fluid pumps are connecting rod operated piston pumps. These are relatively heavy structures, and their service life is also comparatively short.

Therefore there is a need for a new type of drilling fluid pump that is lighter in weight and has a longer service life.

SUMMARY OF THE INVENTION

This need is met by means of a piston pump as disclosed in claim 1.

BRIEF DESCRIPTION OF THE DRAWINGS

Additional features of the invention are disclosed in the dependent claims, and advantages of the invention will be explained in detail in the following description of an exemplary embodiment with reference to the drawings, wherein

DETAILED DESCRIPTION OF THE PREFERRED EMBODIMENTS

Figure 1:
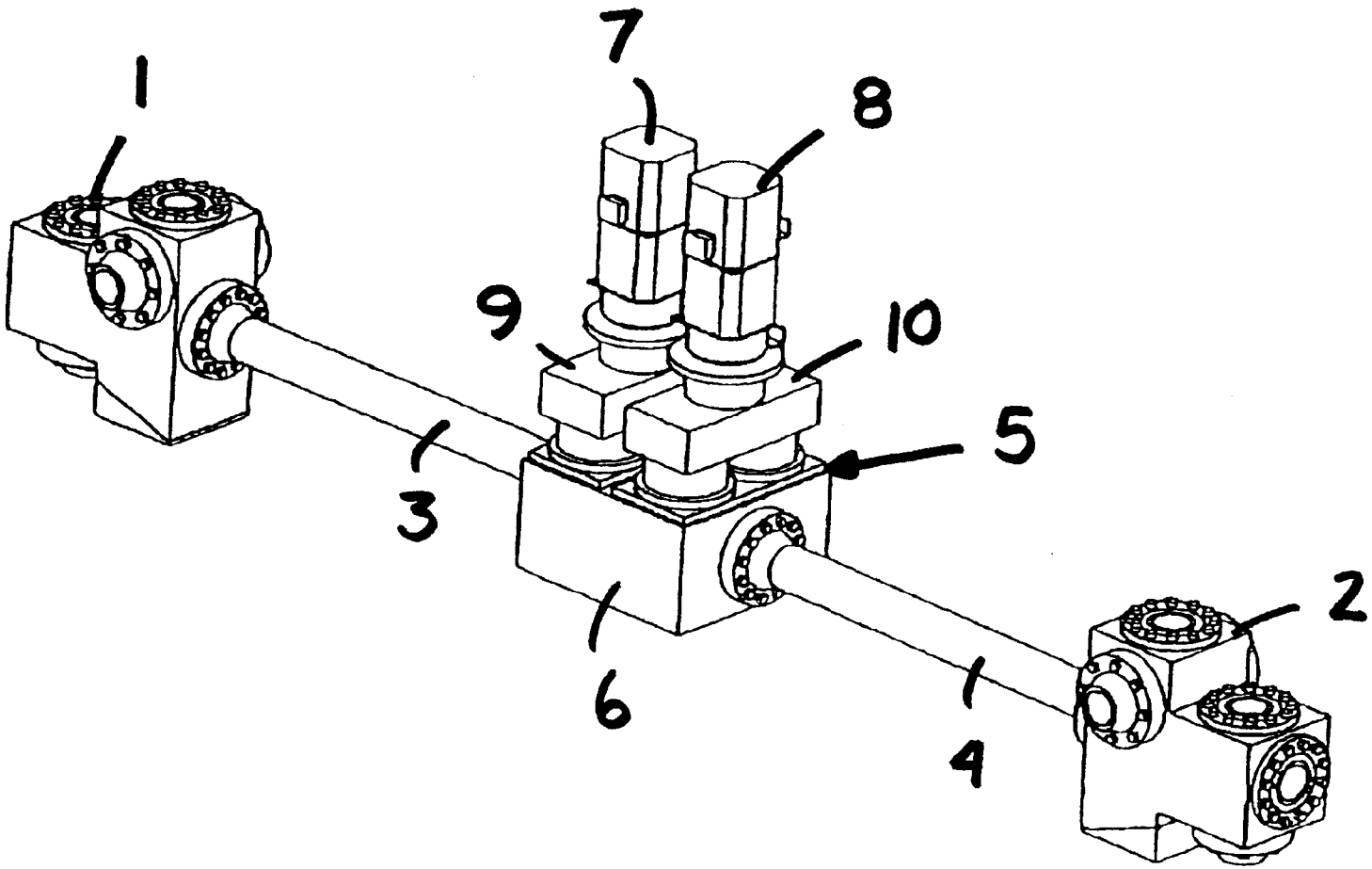
FIG. 1 is a perspective view of a drilling fluid pump according to the invention.

The drilling fluid pump shown in FIG. 1 comprises two valve units 1 and 2, two pump cylinders 3 and 4, and a central drive unit 5. The valve units 1 and 2 are as known from the conventional pumps, and the pump cylinders 3 and 4 are also conventional. Therefore these components are not described in any more detail here.

Figure 2:
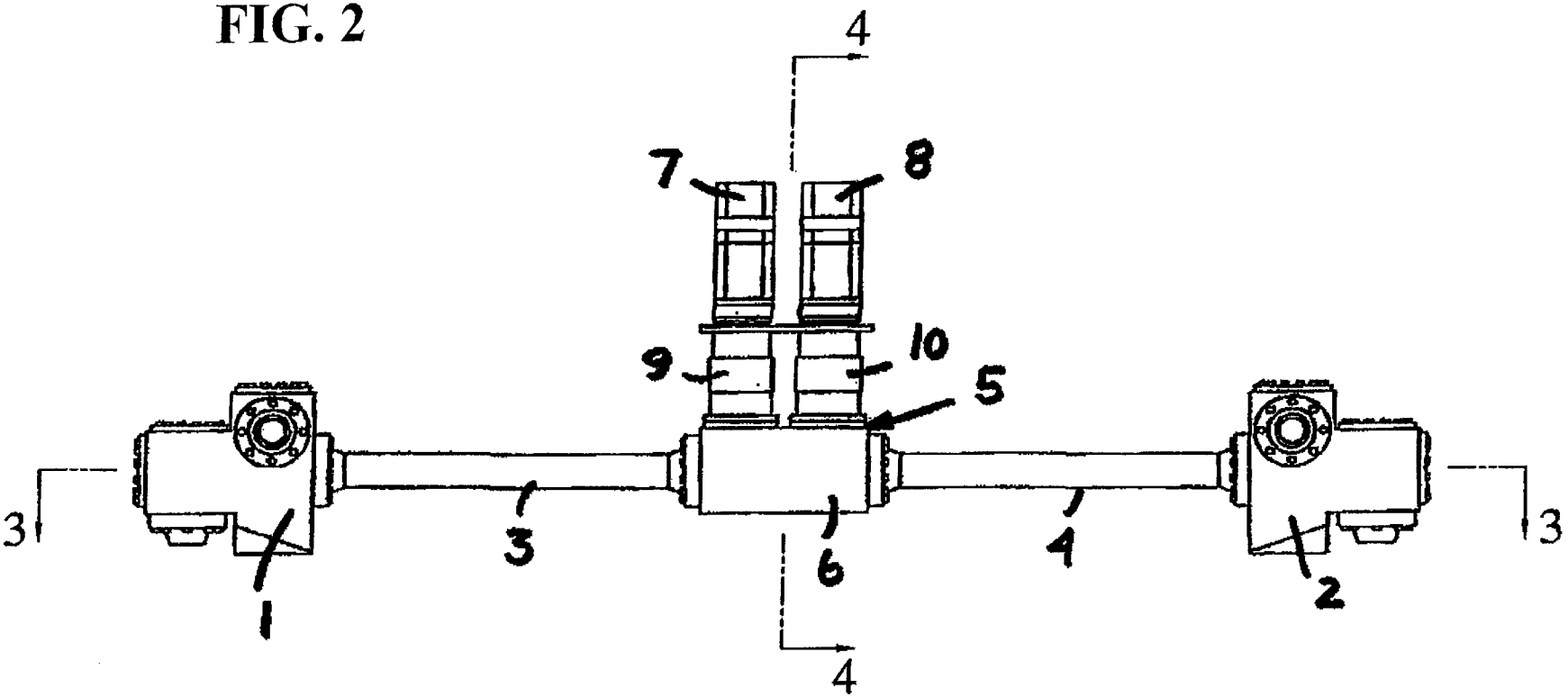
FIG. 2 is a side view of the pump in FIG. 1.
Figure 3B:
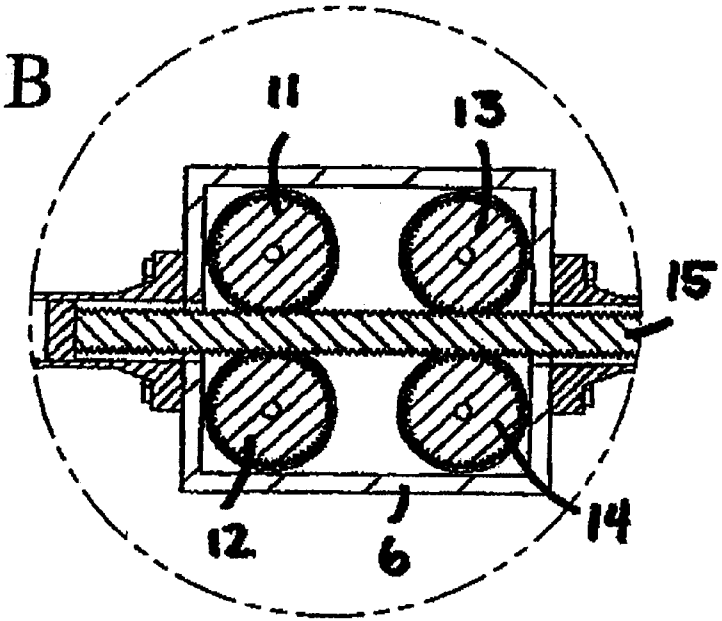
FIG. 3B, is a sectional view taken along a line 3—3 in FIG. 2.
Figure 3A:
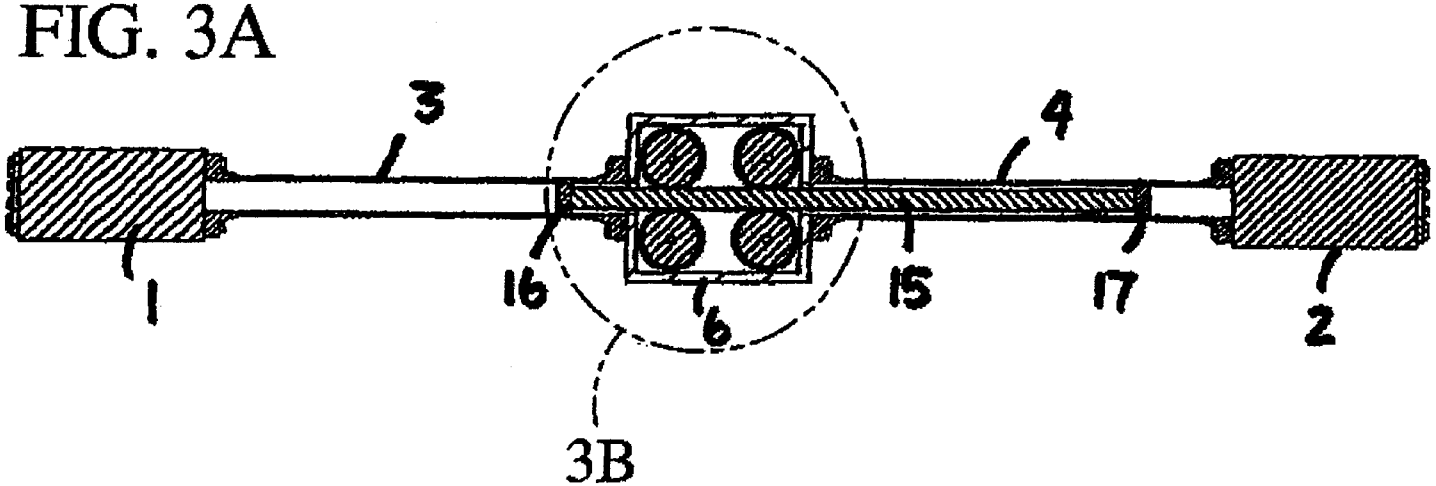
FIG. 3A, with detail
Figure 4:
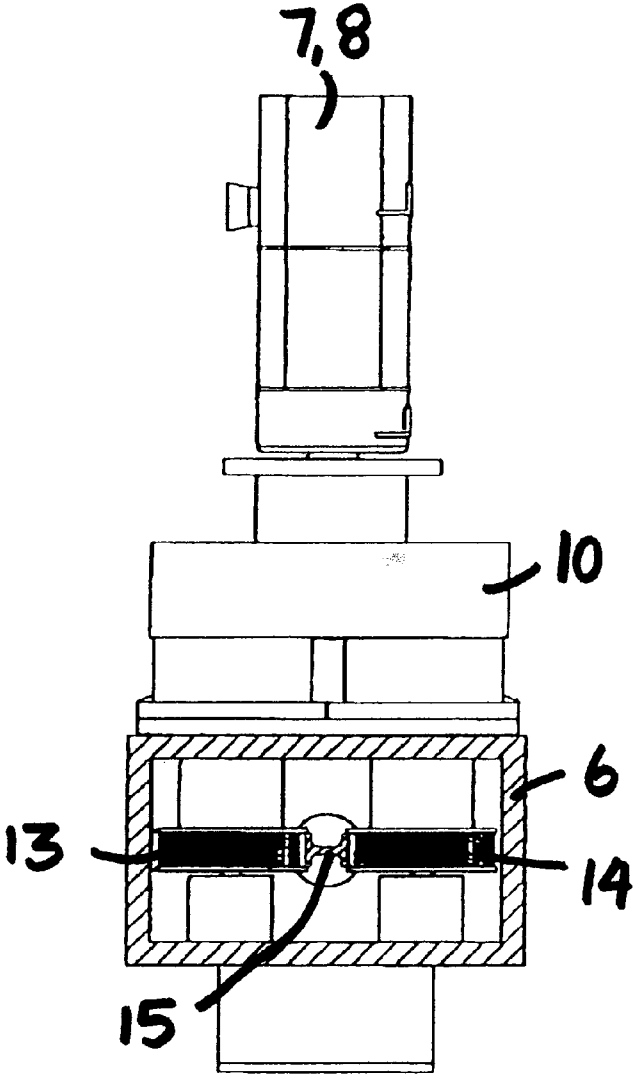
FIG. 4 is a sectional view taken along the line 4—4 in FIG. 2.

As shown in FIGS. 2 and 3, the central drive unit 5 comprises a housing 6 and two electric drive motors 7 and 8 mounted thereon. The two drive motors 7 and 8 are via gearboxes 9, 10 and gear wheels 11–14 drive-connected to a toothed rack 15 which moves in the two pump cylinders 3, 4 as shown in FIG. 3. At each end, the toothed rack 15 has a piston 16 and 17 respectively which act as pump pistons in their respective cylinders 3, 4. The toothed rack 15 has an H-shaped cross-section, see FIG. 4.

The pump shown in FIG. 1 is symmetric, i.e., the two valve units 1, 2 and the pump cylinders 3, 4 are identical to one another.

When the pump is in operation, the toothed rack 15 is moved back and forth by the electric motors 7, 8 via the gearboxes 9, 10 and the gearwheels 13–14. The pistons will then draw in and force out drilling fluid through the associated valve unit 1, 2.

The new drilling fluid pump can be made having a weight that is about four times lighter than the conventional drilling fluid pumps which have heavy drive gears. The reduction in weight will depend on,the length of the cylinders. An expedient pump cylinder length is three meters, which is about six times longer than in a conventional pump.

The piston velocity can then be the same as in a conventional pump, and the pump cylinder diameter can be as in the known pumps, for example as much as 6" in cylinder diameter. A service life is thus obtained for the inventive pump that is six times longer than that of the conventional pumps.

Figure 5:
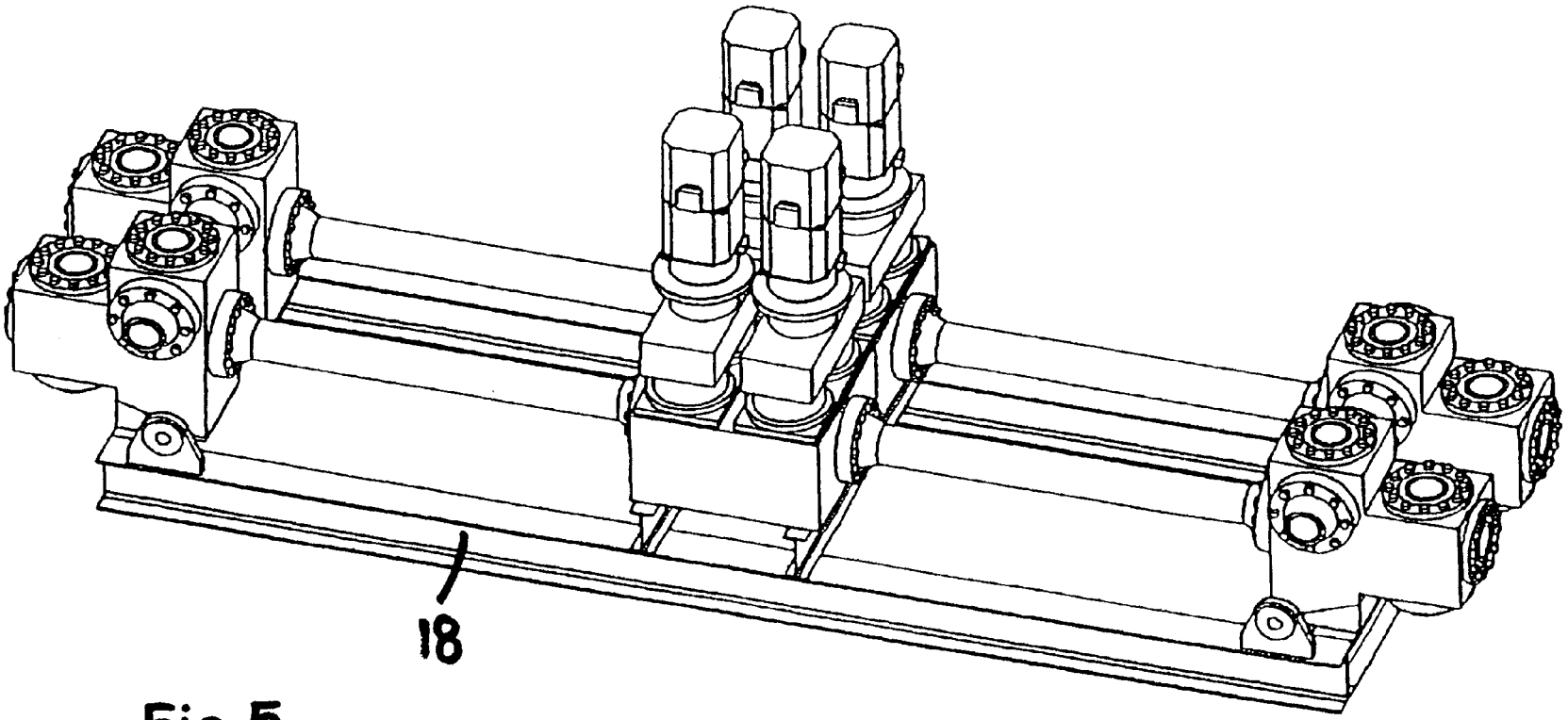
FIG. 5 is a perspective view of an embodiment in which two pumps are placed on a frame.

FIG. 5 shows a drilling fluid pump which differs from that in FIG. 1 only in that it has been "doubled", and where the pumps are placed on a transport or support frame 18.

What is claimed is:

1. A pump unit comprising:

a central housing;

at least two separate elongated pump cylinders attached to the central housing so as to extend in opposite directions from the central housing;

respective pump pistons positioned within the respective pump cylinders and outside of the central housing;

a piston rod in the form of a toothed rack having one of the pump pistons attached to each end of the toothed rack;

a central drive unit comprising electric motors driving respective gear wheels in engaging interaction with the toothed rack for moving the pump pistons back and forth in the pump cylinders, respectively; and a valve unit at each end of the elongated pump cylinders remote from the central housing, each of the valve units containing inlet and outlet valves for the pump cylinders.

2. The pump unit of claim 1, wherein the central housing and the valve units are mounted on a common transport/support frame.

3. The pump unit of claim 1, wherein the electric motors are reversible so as to drive the respective gear wheels in opposite directions to move the pump pistons back and forth in the pump cylinders.

4. The pump unit of claim 1, wherein at least a first electric motor is arranged to drive respective first gear wheels in a first direction and at least a second electric motor is arranged to drive respective second gear wheels in an opposite direction so to move the pump pistons back and forth in the pump cylinders.

* * * * *